US008350200B1

(12) United States Patent
Hawkins et al.

(10) Patent No.: US 8,350,200 B1
(45) Date of Patent: Jan. 8, 2013

(54) PASSIVE AEROSURFACE ADJUSTMENT FOR STATIC MARGIN MANAGEMENT

(75) Inventors: Andrew W. Hawkins, Orlando, FL (US); Christopher E. Willingham, Orlando, FL (US); Kit W. Grabbe, Castle Rock, CO (US)

(73) Assignee: Lockheed Martin Corporation, Bethesda, MD (US)

( * ) Notice: Subject to any disclaimer, the term of this patent is extended or adjusted under 35 U.S.C. 154(b) by 862 days.

(21) Appl. No.: 12/411,815

(22) Filed: Mar. 26, 2009

(51) Int. Cl.
*F42B 15/01* (2006.01)

(52) U.S. Cl. ..... 244/3.24; 244/3.28

(58) Field of Classification Search ..... 244/3.24, 244/3.26, 3.28; 102/374
See application file for complete search history.

(56) References Cited

U.S. PATENT DOCUMENTS

| | | | | |
|---|---|---|---|---|
| 3,139,033 | A * | 6/1964 | Geissler et al. | 244/3.22 |
| 3,158,100 | A * | 11/1964 | Finley | 102/377 |
| 3,684,215 | A * | 8/1972 | Jacobson et al. | 244/3.27 |
| 5,169,095 | A * | 12/1992 | Lecat | 244/3.28 |
| 6,450,452 | B1 * | 9/2002 | Spencer et al. | 244/159.3 |
| 7,185,847 | B1 * | 3/2007 | Bouchard et al. | 244/46 |

OTHER PUBLICATIONS

August, James A. et al., "Preliminary Design of Smart Structure Fins for High-Speed Missiles", *Proceedings of the SPIE—The International Society for Optical Engineering* vol. 2721 1996 , 58-65.

* cited by examiner

*Primary Examiner* — Robert P. Swiatek
*Assistant Examiner* — Michael Kreiner
(74) *Attorney, Agent, or Firm* — Withrow & Terranova, PLLC

(57) ABSTRACT

A missile and a method for reducing the required control forces during the flight of a missile, comprising providing to the missile movable parts that adjust center of pressure of the missile as they move and as fuel in the missile is consumed, moving the movable parts so as to continuously move the center of pressure toward the moving center of gravity of the missile.

12 Claims, 4 Drawing Sheets

PASSIVE AEROSURFACE ADJUSTMENT FOR STATIC MARGIN MANAGEMENT

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention

The present invention relates to methods and apparatuses for control of missiles while in flight.

2. Description of Related Art

Demanding requirements placed on small missiles include reduced weight and cost with retained or increased performance. Many missiles experience shifts in the center of gravity (CG) location during flight due to the consumption of onboard fuel mass or other types of ejecta. Missile maneuverability and range performance are degraded when a CG shift causes the static margin (SM) to increase. A larger SM requires a larger control moment to achieve required performance, causing more onboard resources such as power or fuel to be expended. The present invention retains desired performance by shifting the center of pressure (CP) to compensate for the shifting CG. This maintains the desired SM and minimizes the required control moment.

BRIEF SUMMARY OF THE INVENTION

The present invention is of a missile and a method for controlling flight of a missile, comprising: providing to the missile movable parts that adjust center of pressure of the missile as they move; and as fuel in the missile is consumed, moving the movable parts so as to continuously move the center of pressure toward the moving center of gravity of the missile. In one embodiment, the movable parts comprise one or more fins, which most preferably sweep forward as the fuel is consumed. In another embodiment, the moveable parts comprise one or more canards, which most preferably sweep forward as the fuel is consumed. The invention reduces required control forces for maneuvers by the missile, most preferably reducing required control forces, depending on the missile design, by 50% or more. Preferably, the moveable parts do not create a larger control moment of the missile, manage static margin of the missile to achieve approximately neutral stability, and are controlled by one or more spring and damper systems.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention is of a missile, missile control apparatus, and method that retains desired performance by shifting the center of pressure (CP) of a missile to compensate for the shifting CG, thus maintaining the desired SM. Airframe surfaces are passively modified, resulting in CP location changes that compensate for the shifting CG. For example, on a missile with a forward moving CG, the compensating CP shift may be achieved by using tail fins that sweep forward or canards that extend during flight or any other method that correctly alters the aerodynamic performance of the vehicle. In general, the direction and speed of control surface modification depends on the design and location of the aerodynamic surface. In the example of a forward sweeping tail, the sweep angle and rate of sweep can be passively controlled by the use of a spring and damper system. The spring and damper system may be realized using shape memory alloys or any other technology capable of storing and releasing mechanical energy.

For example, range and target lethality requirements for shoulder launched missiles with multi-mission capabilities are driving designs toward high system accuracy and low system weight. To achieve this capability, inert mass must be reduced to a minimum and components must become multi-functional. In keeping with this design philosophy, the preferred missile of the present invention is powered by a boost-sustain rocket motor with an integrated reaction jet control system. The size of the reaction jet control system is proportional to the control moments it is required to generate. These control moments are minimized by keeping the CP location as close to the CG as possible.

Conventional control systems, with significant power resources and large design margins, handle forward movement of the CG by reacting a larger control moment on the airframe to achieve trimmed flight or perform maneuvers. The larger moment is achieved by producing larger aero surface deflections which generate additional induced drag that must be overcome by the propulsion system and require additional margins for on-board resources such as power and fuel.

Management of the SM to achieve near neutral stability reduces the control moment needed to meet maneuverability requirements. Missiles that do not manage the SM also require control systems with higher torque and/or bandwidth. A smaller control moment requires less control force which results in lower induced drag and the consumption of less on-board resources such as power and fuel which in turn results in lower weight and cost. As a consequence of weight saved from reduced on-board control system requirements, the option to allocate more weight to propulsion or payload is gained.

Figure 1:
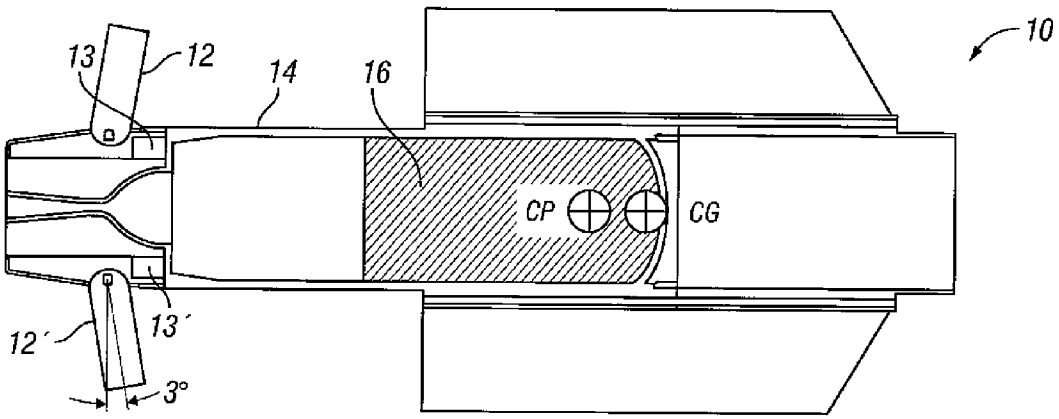
FIG. 1 is a schematic cut-away diagram of a missile according to the invention showing CP and CG positions at the start of the sustain phase and with the fins swept forward about 3 degrees.
Figure 2:
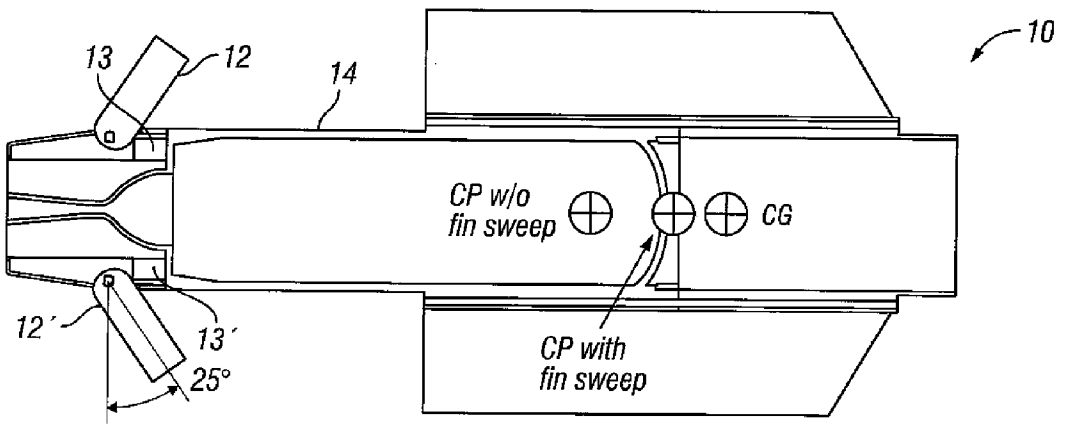
FIG. 2 is a schematic cut-away diagram of a missile according to the invention showing CP and CG positions after motor burnout and with the fins swept forward about 25 degrees, and also showing the CP position without use of the fins of the invention.

An embodiment of the invention 10 is shown in FIGS. 1 and 2. Airframe surfaces 14 are passively modified resulting in CP location changes that compensate for the shifting CG due to consumption of propellant 16. A typical missile has a CG that moves forward as fuel is consumed, so the compensating CP shift can be achieved with two or more tail fins 12,12' that sweep forward during flight. The sweep angle and rate of sweep can be passively controlled by the use of mechanical mechanisms such as a spring and damper system 13,13'.

Figure 3:
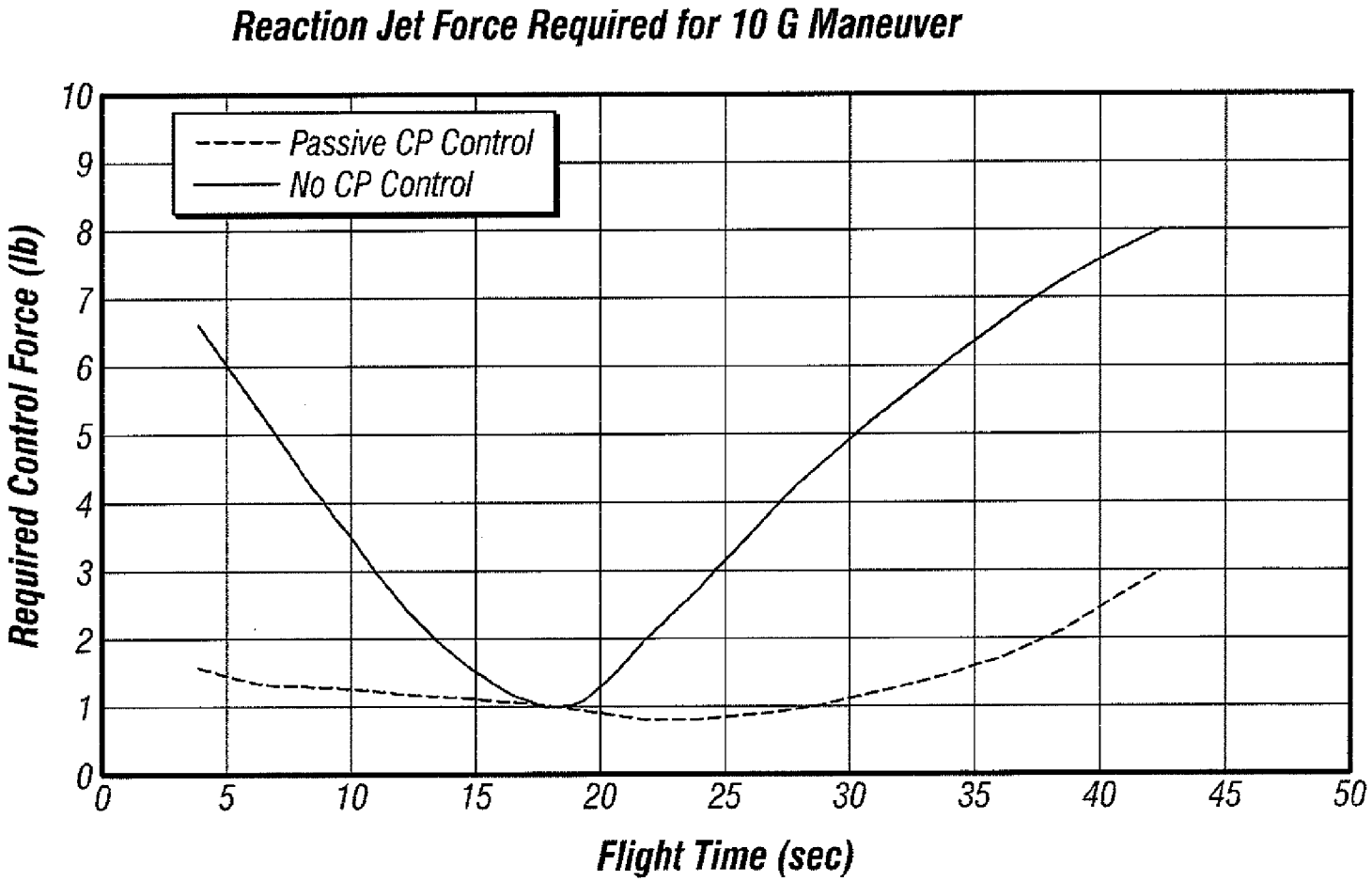
FIG. 3 is a plot of reaction jet force (in lbs) required to perform a 10 G maneuver versus flight time (in sec) both with and without the passive CP control of the invention.
Figure 4:
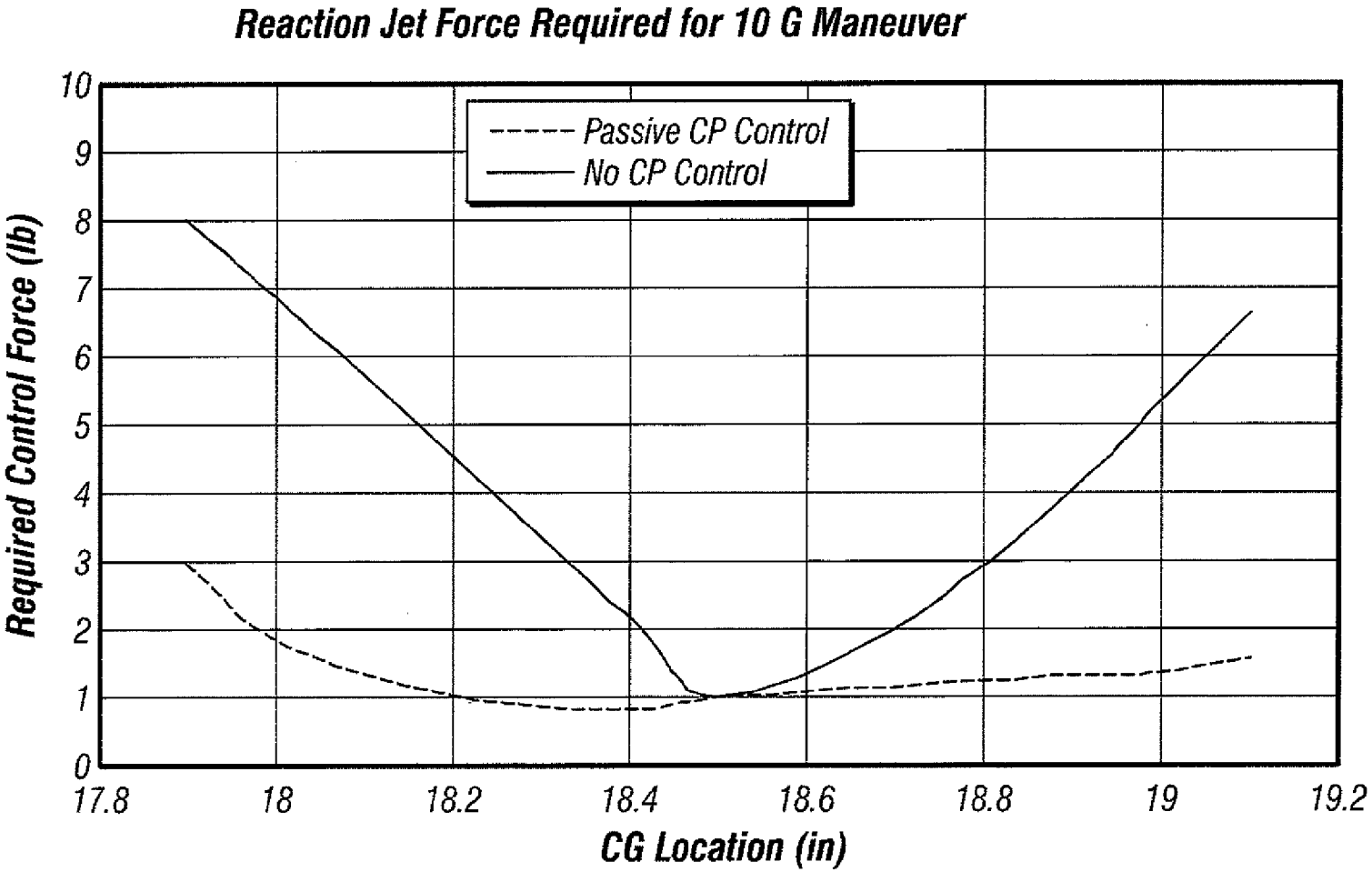
FIG. 4 is a plot of the control force required to perform a 10 G maneuver versus missile CG position both with and without the active CP control of the invention.

Referring to FIGS. 3 and 4, required control forces for a 10 G maneuver are reduced by over 50% through a passive CP management system according to the invention, greatly reducing missile resources required by the control system during flight.

Figure 5:
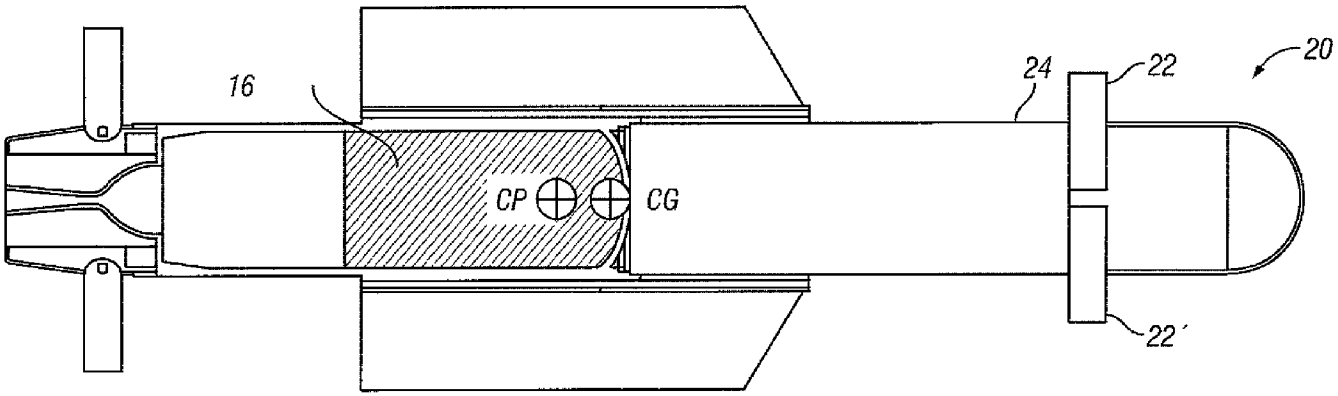
FIG. 5 is a schematic cut-away diagram of a missile according to the invention showing CP and CG positions at the start of the sustain phase and with the canards unextended.
Figure 6:
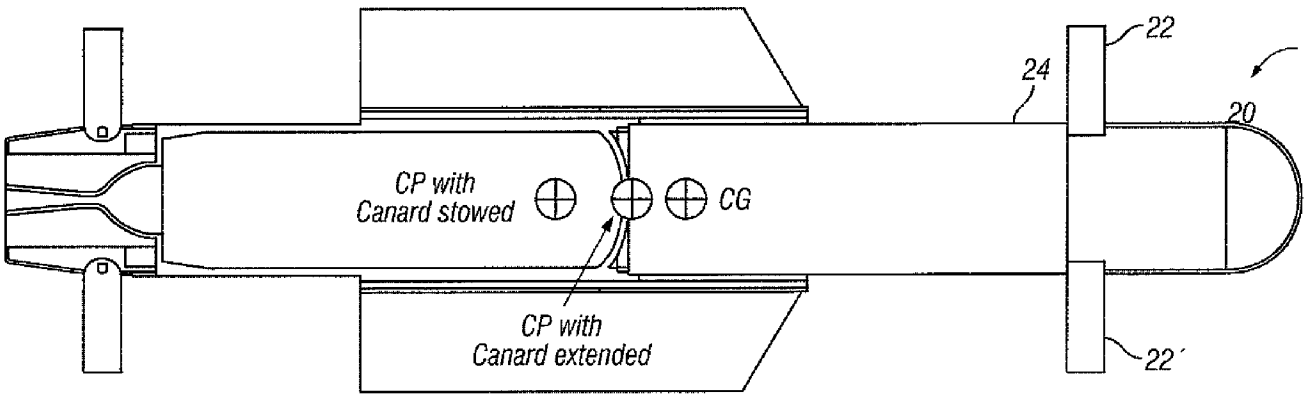
FIG. 6 is a schematic cut-away diagram of a missile according to the invention showing CP and CG positions after motor burnout and with the canards fully extended, and also showing the CP position without use of the canards of the invention.

Another embodiment of the invention 20 is shown in FIGS. 5 and 6, which embodiment employs canards rather than fins. Again, airframe surfaces 24 are passively modified resulting in CP location changes that compensate for the shifting CG due to consumption of propellant 16. A typical missile has a CG that moves forward as fuel is consumed, so the compensating CP shift can be achieved with two or more canards 22,22' that sweep forward (not shown) or extend during flight. Again, the sweep angle and rate of sweep or extension can be passively controlled by the use of mechanical mechanisms such as a spring and damper system.

Conventional control systems, with significant power resources and large design margins, handle forward movement of the CG by creating a larger control moment on the airframe to achieve trimmed flight or perform maneuvers. The larger moment is achieved by producing larger aero-surface deflections which generate additional induced drag that must be overcome by the propulsion system and require additional margins for on-board resources such as power and fuel.

The present invention improves on this significantly because management of the SM to achieve near neutral stability reduces the control moment needed to meet maneuverability requirements. A smaller control moment requires less control force which results in lower induced drag and the consumption of less on-board resources such as power and fuel which in turn results in lower weight and cost. As a consequence of weight saved from reduced on-board control system requirements, the option to allocate more weight to propulsion or payload is gained. Missiles that do not manage the SM require control systems with higher torque and/or bandwidth.

The present invention is an enabler of the Reaction Jet Control (RJC) option, as implemented in a multi-modal missile, by holding the required thrust for attitude and maneuver to levels that enable more propellant to be utilized for range and speed maintenance while minimizing the amount of electrical power required to provide actuation. It allows for missile maneuver capability to stay constant over the entire flight.

Note that in the specification and claims, "about" or "approximately" means within twenty percent (20%) of the numerical amount cited.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A missile comprising movable parts that adjust center of pressure of the missile as fuel therein is consumed by continuously moving the center of pressure toward the moving center of gravity of the missile, wherein said movable parts comprise one or more fins, wherein said one or more fins sweep forward as the fuel is consumed, and wherein said one or more fins do not translate forward or backward.

2. The missile of claim 1 wherein said movable parts reduce required control forces for maneuvers by said missile.

3. The missile of claim 2 wherein said movable parts reduce required control forces, depending on the missile design, by 50% or more, as against a missile design without said moveable parts.

4. The missile of claim 1 wherein said moveable parts do not create a larger control moment of the missile than a missile without said moveable parts.

5. The missile of claim 1 wherein said moveable parts manage static margin of said missile to achieve approximately neutral stability.

6. The missile of claim 1 wherein said moveable parts are controlled by one or more spring and damper systems.

7. A method for controlling flight of a missile, the method comprising the steps of:

providing to the missile movable parts that adjust center of pressure of the missile as they move; and as fuel in the missile is consumed, moving the movable parts so as to continuously move the center of pressure toward the moving center of gravity of the missile; and wherein the movable parts comprise one or more fins, wherein the one or more fins sweep forward as the fuel is consumed, and wherein the one or more fins do not translate forward or backward.

8. The method of claim 7 wherein the method reduces required control forces for maneuvers by the missile.

9. The method of claim 8 wherein the method reduces required control forces, depending on the missile design, by 50% or more, as against a missile design without the moveable parts.

10. The method of claim 7 wherein the moveable parts do not create a larger control moment of the missile than a missile without the moveable parts.

11. The method of claim 7 wherein the moveable parts manage static margin of the missile to achieve approximately neutral stability.

12. The method of claim 7 wherein the moveable parts are controlled by one or more spring and damper systems.

* * * * *

UNITED STATES PATENT AND TRADEMARK OFFICE

CERTIFICATE OF CORRECTION

PATENT NO. : 8,350,200 B1
APPLICATION NO. : 12/411815
DATED : January 8, 2013
INVENTOR(S) : Andrew H. Hawkins, Christopher E. Willingham and Kit W. Grabbe It is certified that error appears in the above-identified patent and that said Letters Patent is hereby corrected as shown below:

In the Inventors section on the cover sheet, replace "Andrew W. Hawkins, Orlando, FL (US); Christopher E. Willingham, Orlando, FL (US); Kit W. Grabbe, Castle Rock, CO (US)" with --"Andrew H. Hawkins, Orlando, FL (US); Christopher E. Willingham, Orlando, FL (US); Kit W. Grabbe, Castle Rock, CO (US)"--.

Signed and Sealed this
Twelfth Day of March, 2013

Teresa Stanek Rea
*Acting Director of the United States Patent and Trademark Office*